United States Patent [19]

Cole

[11] Patent Number: 4,496,124

[45] Date of Patent: Jan. 29, 1985

[54] BOTTLE SUPPORT

[75] Inventor: Gerald Cole, Victor, N.Y.

[73] Assignee: Creative Cellars, Inc., Ft. Washington, Md.

[21] Appl. No.: 532,805

[22] Filed: Sep. 15, 1983

[51] Int. Cl.[3] ..... A47G 23/02

[52] U.S. Cl. ..... 248/146; D7/70; 211/74; 215/100 R; 248/152; 273/1 GF

[58] Field of Search ..... 248/146, 152, 133; 211/74; 215/100 R; D7/70, 71; D6/188; 46/131; 273/1 GF

[56] References Cited

U.S. PATENT DOCUMENTS

| | | | |
|---|---|---|---|
| D. 60,440 | 2/1922 | Boucher, Jr. | D9/455 |
| D. 252,065 | 6/1979 | Leventhal | D7/71 |
| D. 253,802 | 1/1980 | Loud et al. | D7/71 |
| 1,079,158 | 11/1913 | Beatty | 248/450 |
| 2,738,188 | 3/1956 | Hoffman | 46/131 |
| 3,100,054 | 8/1963 | Rubens | 215/1 |
| 3,185,291 | 5/1965 | Lerner | 211/74 |
| 3,286,849 | 11/1966 | Dominos | 211/74 |
| 3,615,150 | 10/1971 | Indrunas | 211/74 |
| 3,870,298 | 3/1975 | Varga | 273/1 GF |
| 3,885,698 | 5/1975 | Lebel et al. | 248/364 X |
| 3,901,389 | 8/1975 | Belokin, Jr. | D7/71 X |
| 4,066,171 | 1/1978 | Fowlie | 211/69.1 |

FOREIGN PATENT DOCUMENTS

| | | | |
|---|---|---|---|
| 2545971 | 4/1977 | Fed. Rep. of Germany | 211/74 |
| 2470158 | 5/1981 | France | 211/74 |
| 418111 | 2/1967 | Switzerland | 211/74 |

OTHER PUBLICATIONS

Sears, Zemansky and Young *University Physics* 5th Edition (Massachusetts, Addison-Wesley, 1976) pp. 39–42.

"House and Garden", Nov. 1971, p. 209.

"House and Garden", Nov. 1971, p. 175.

*Primary Examiner*—J. Franklin Foss

*Assistant Examiner*—David L. Talbott

*Attorney, Agent, or Firm*—Irvin A. Lavine

[57] ABSTRACT

A bottle support for engaging the neck of a bottle and supporting it in a slightly inclined position. An oblique prism has a rectangular base and two sets of parallel sides. A hole penetrates the prism through the sides, generally parallel to two of the sides. The center of gravity of the body lies outside the base and the combined center of gravity of the body and bottle lies above the base.

13 Claims, 3 Drawing Figures

BOTTLE SUPPORT

TECHNICAL FIELD

The present invention relates to a bottle support, for holding a bottle by its neck, and more particularly to such a bottle support in which there is an upstanding column which also serves as the base, and which is inclined.

BACKGROUND ART

There have been provided various devices for holding objects, particularly bottles which have a neck. Such bottle supports, in addition to the conventional racks for holding bottles in tiers, and cradles for supporting bottles on a surface such as a table, include certain bottle holders which support the bottle by having the neck of the bottle pass through an opening in an upstanding column.

Belokin, Jr. U.S. Pat. No. 3,901,389 discloses a vertical column having a plurality of openings which receive the necks of wine bottles to support them. A particular embodiment of the bottle holder shown in this patent provides an inclined planar board or wall having spaced openings for receiving the neck of a bottle, with the bottle substantially parallel to a table on which the device rests: there is provided a base bracket which extends at a slight angle to the supporting table or surface, which engages the column at one end, and at its other end engages the supporting table or surface.

Lebel et al. U.S. Pat. No. 3,885,698 discloses a holder for containers of aerosols, and includes a base-plate having an inclined supporting face which may be tilted to hold the aerosol container in an inclined position.

Boucher U.S. Pat. No. Des. 60,440 provides a collar for encircling the end of a cylindrical receptacle, the collar and the opposite end of the receptacle resting on a support surface.

Loud et al. U.S. Pat. No. Des. 253,802 discloses a bottle holder which includes boards or walls extending vertically and having inclined holes through them.

The bottle holders of the prior art which hold the bottle by its neck have required the provision of multiple elements, usually a column and a base or bracket to engage and support the column, which in turn supports the bottle. In addition to requiring two pieces of material which must be separately manufactured and subsequently assembled, the appearance of the support of this nature is both conventional and clumsy. Where a single element has been used, the container itself rests upon the support surface.

DISCLOSURE OF INVENTION

The present invention provides a holder for objects such as bottles of conventional, necked configuration such as are widely used for the selling of wine. The bottle support consists of a body including a base surface, with the body extending upwardly from the base surface at an angle to the vertical, with the center of gravity of said body being above a point which is outside the base surface. The body is provided with an opening which supports a wine bottle, or the like, by the neck. The combined center of gravity of the wine bottle, or the like, and the body is above a point within the base surface, and the base surface is the sole support for the body and the bottle. Preferably, the body is inclined at an angle of thirty degrees to the vertical. The body may be made of wood, plastic, or similar materials.

Among the objects of the present invention are the provision of a bottle support made of a single element, and to provide a bottle support made of a single element which will hold a bottle above a supporting surface, such as a table, with the bottle extending generally horizontally, or slightly downwardly inclined.

Another object of the present invention is the provision of a very economical bottle support, the bottle support being of pleasing appearance, and, when combined with a bottle, having a startling and aesthetic appearance.

MODES FOR CARRYING OUT THE INVENTION

Figure 1:
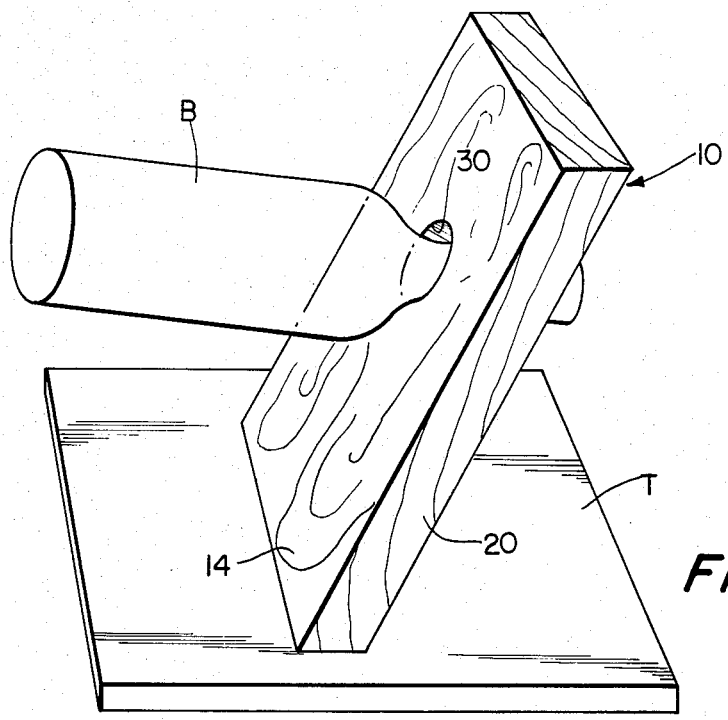
FIG. 1 is a perspective view of a bottle support in accordance with the present invention resting on a supporting surface, such as a table, and having a wine bottle supported by it.
Figure 2:
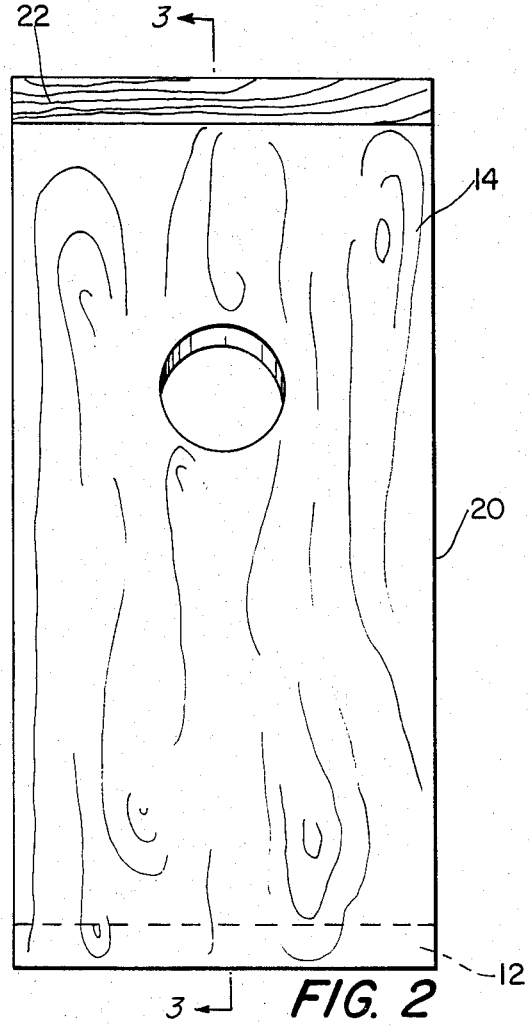
FIG. 2 is an elevational view of the bottle support shown in FIG. 1.

Referring now to the drawings, there is shown in FIG. 1 a horizontal support T, which may be a table. A bottle support 10 is shown, placed on and supported by the table T, and having a bottle B associated with it. In particular, the bottle support 10 consists of a body of wood, plastic or other suitable material, and has a lower supporting base surface 12 which rests upon the table T. As shown in FIG. 2, the base surface 12 is a regular polygon, specifically a rectangle. The body 10 is in the form of an oblique prism having a first side 14 and a parallel side 16 (see FIG. 3), the body also having a second pair of parallel sides 18 and 20 perpendicular to the sides 14 and 16. At its upper end, the body has a second base surface 22 which is parallel to the base surface 12.

Figure 3:
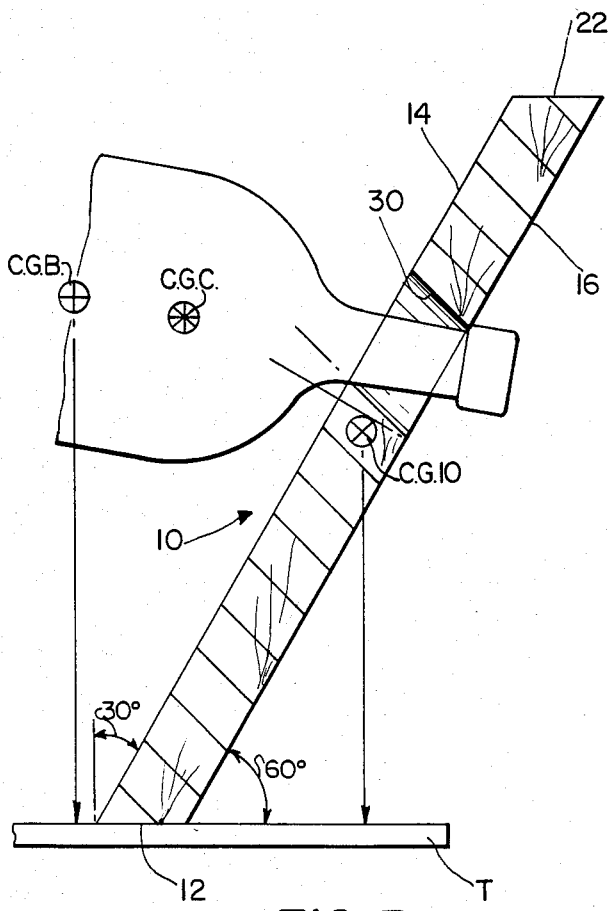
FIG. 3 is a side, cross-sectional view, taken on the line 3—3 of FIG. 2, and rotated thirty degrees clockwise.

As shown in FIG. 3, the surface 16 is at an angle of sixty degrees to the horizontal surface of the table T, and the surface 14 is at an angle of thirty degrees to the vertical, indicated by the line V.

Extending through the body 10, from the face 14 to and through the face 16, is an opening 30 which, in the position shown in FIG. 3, is inclined slightly upwardly, and a bottle B has its neck extending through the opening 30, and thus through the body or support 10. Opening 30 is closer to surface 22 than to surface 12. The bottle is inclined upwardly from the opening at the end of the neck thereof, so that the bottle mouth or opening is preferably lower than the bottom of the bottle B.

In one preferred embodiment, the body 10 is made of wood, the surfaces 14 and 16 having a width of five and one-half inches, the body having a thickness between these surfaces of one inch, the center of the opening 30 being equally distant from the sides 18 and 20. The opening 30 has a diameter of one and five-eighths inches, and the opening 30 does not extend perpendicularly through the body 10, but its axis is at an angle of twenty degrees to the perpendicular, the terminous of opening 30 at the face 14 being higher than the terminous of opening 30 of the side 16.

The center of gravity CG10 is seen to be above a point A which is outside of the base surface 12. Hence, the body 10 alone, when placed upon the base surface 12 is unstable, and would fall. The center of gravity CGB of the bottle B, when the bottle B has its neck extending through the opening 30, is, in the showing in FIG. 3, somewhat to the left of the edge defined by the juncture of the base surface 12 and the side 16; the point A is to the right of this juncture. The bottle support 10 and the bottle B have a combined center of gravity, designed CG-C, which lies above a point within the base surface 12, being neither to the right of the intersection of base surface 12 and side 16, nor to the left of the juncture of base surface 12 and side 14. Consequently, the bottle B and the bottle support 10, when assembled in the manner as shown in FIGS. 1 and 3, is stable, all weight of the bottle B and the support 10 passing through the surface 12 to the table T. No other support element or structure is provided, and the surface 12 provides the sole support for the body 10 and the bottle B.

There has been provided a unique bottle support of simple construction, and pleasing, albeit surprising appearance, when combined with a bottle which it supports. The bottle support as herein disclosed may be made of various selected materials, and may be ornamented, colored, etc. as desired. If made of plastic, it may be colored, transparent, marbelized, textured, etc.

Although as herein disclosed the bottle support is preferably an oblique prism with two pairs of parallel sides, extending from a rectangular base surface, other configurations will be apparent to those skilled in the art. Accordingly, an embodiment of the present invention is illustrated in the specification and drawings.

It will be obvious to one skilled in the art that various changes may be made without departure from the spirit of the invention, and therefore the invention is not limited to that shown in the drawings, and described in the specification but only as indicated in the appended claims.

I claim:

1. A bottle and support comprising:

(a) a body including a base surface, (b) said body extending upwardly from said base surface at an angle to the vertical, (c) the center of gravity of said body being above a point outside said base surface, (d) means on said body for supporting a bottle, (e) said bottle supported by said supporting means and having a center of gravity above a point on the opposite side of that edge of the base surface nearest said first point from said first point, (f) the combined center of gravity of said body and said bottle being above a point within said base surface, (g) said base surface being the sole support for said body and said bottle.

2. The bottle and support of claim 1, said base surface being a polygon and said body being an oblique prism.

3. The bottle and support of claim 2, said base surface being a rectangle.

4. The bottle and support of claim 3, said body having two pairs of parallel sides.

5. The bottle and support of claim 1, said angle being approximately sixty degrees.

6. The bottle and support of claim 1, said body being of wood.

7. The bottle and support of claim 1, said body being of plastic.

8. The bottle and support of claim 1, said means for supporting a bottle comprising an opening through said body.

9. The bottle and support of claim 8, said bottle having a neck, said opening comprising means for engaging the neck of said bottle.

10. The bottle and support of claim 9, said opening comprising means for supporting said bottle with its axis inclined upwardly from an opening at the end of said neck of said bottle.

11. The bottle and support of claim 1, said base being a rectangle, said body having first and second pairs of parallel sides extending upwardly from said base surface, and said body having a second base surface substantially parallel to said first base surface.

12. The bottle and support of claim 1, said body having a second base surface substantially parallel to said first base surface.

13. The bottle and support of claim 12, said supporting means comprising an opening through said body closer to one said base surface than to the other.

* * * * *